US007585182B2

(12) United States Patent
Asante et al.

(10) Patent No.: US 7,585,182 B2
(45) Date of Patent: Sep. 8, 2009

(54) METHOD AND APPARATUS FOR CONNECTING A CABLE

(75) Inventors: Kwabena Asante, Austin, TX (US); William O. Bain, Leander, TX (US); Anil Kurugode, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 166 days.

(21) Appl. No.: 11/227,364

(22) Filed: Sep. 15, 2005

(65) Prior Publication Data

US 2007/0059977 A1 Mar. 15, 2007

(51) Int. Cl.
*H01R 13/00* (2006.01)

(52) U.S. Cl. ..... 439/502

(58) Field of Classification Search ..... 439/502, 439/620, 362, 639, 650
See application file for complete search history.

(56) References Cited

U.S. PATENT DOCUMENTS

| | | | | |
|---|---|---|---|---|
| 3,299,323 | A * | 1/1967 | Dudley | 361/725 |
| 4,164,731 | A * | 8/1979 | King | 340/286.07 |
| 5,482,478 | A | 1/1996 | Liao | |
| 5,855,064 | A * | 1/1999 | Chang | 29/861 |
| D409,572 | S * | 5/1999 | van Putten | 439/620 |
| 6,672,896 | B1 * | 1/2004 | Li | 439/502 |
| 2004/0036442 | A1 * | 2/2004 | Wu | 320/107 |
| 2008/0001448 | A1 * | 1/2008 | Vitito | 297/217.3 |

* cited by examiner

*Primary Examiner*—Jean F Duverne
(74) *Attorney, Agent, or Firm*—Haynes and Boone, LLP

(57) ABSTRACT

A cable connecting apparatus includes a base. A plug member extends in a first direction from the base. A cable extends from the base in the first direction. The plug member may be connected to a socket, whereby the cable connecting apparatus provides the cable with a strain relieved 180 degree bend.

22 Claims, 7 Drawing Sheets

300
302b
308
308a
306
302c
304a
304c
304b
304
302
302a
302d 500
502
PROVIDE CABLE CONNECTING APPARATUS
504
COUPLE CABLE CONNECTING APPARATUS TO SOCKET MEMBER
506
WRAP CABLE AROUND SOCKET MEMBER
508
COUPLE SOCKET MEMBER TO INFORMATION HANDLING SYSTEM
510
COUPLE CABLE TO POWER SOURCE

METHOD AND APPARATUS FOR CONNECTING A CABLE

BACKGROUND

The present disclosure relates generally to information handling systems, and more particularly to a method and apparatus for connecting a cable to an information handling system.

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems typically include a variety of cables for connecting various components to the information handling system and for connecting the information handling system to other information handlings systems, power supplies, and various data sources. The connecting of these cables to the information handling systems, power sources, and data sources can raise a number of issues.

For example, some information handling systems connect to power sources through an adapter. The adapter typically includes a cable which connects to the information handling system and a plug channel. An AC cable is then plugged into the plug channel and a power outlet in order to supply the information handling system with power through the adapter.

Problems can arise when the AC cable is longer than is needed or the adapter is put in storage, and the user wraps the AC cable around the adapter. Wrapping the AC cable around the adapter places the AC cable under stress by bending the cable in a tight radius which can result in damage to the cable and in an inability to supply power to the information handling system.

Accordingly, it would be desirable to provide a method and apparatus for connecting a cable to an information handling system absent the disadvantages found in the prior methods discussed above.

SUMMARY

According to one embodiment, a cable connecting apparatus is provided that includes a base, a plug member extending in a first direction from the base, and a cable extending from the base in the first direction.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

Figure 1:
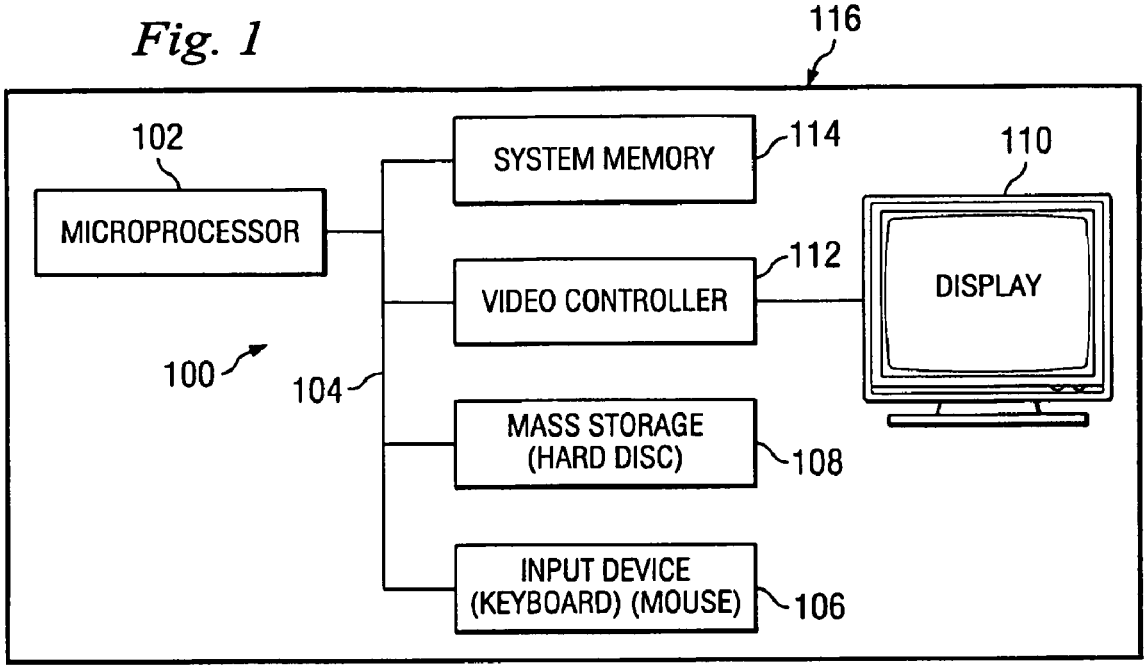
FIG. 1 is a schematic view illustrating an embodiment of an information handling system.

In one embodiment, information handling system 100, FIG. 1, includes a microprocessor 102, which is connected to a bus 104. Bus 104 serves as a connection between microprocessor 102 and other components of computer system 100. An input device 106 is coupled to microprocessor 102 to provide input to microprocessor 102. Examples of input devices include keyboards, touchscreens, and pointing devices such as mouses, trackballs and trackpads. Programs and data are stored on a mass storage device 108, which is coupled to microprocessor 102. Mass storage devices include such devices as hard disks, optical disks, magneto-optical drives, floppy drives and the like. Information handling system 100 further includes a display 110, which is coupled to microprocessor 102 by a video controller 112. A system memory 114 is coupled to microprocessor 102 to provide the microprocessor with fast storage to facilitate execution of computer programs by microprocessor 102. In an embodiment, a chassis 116 houses some or all of the components of information handling system 100. It should be understood that other buses and intermediate circuits can be deployed between the components described above and microprocessor 102 to facilitate interconnection between the components and the microprocessor.

Figure 2:
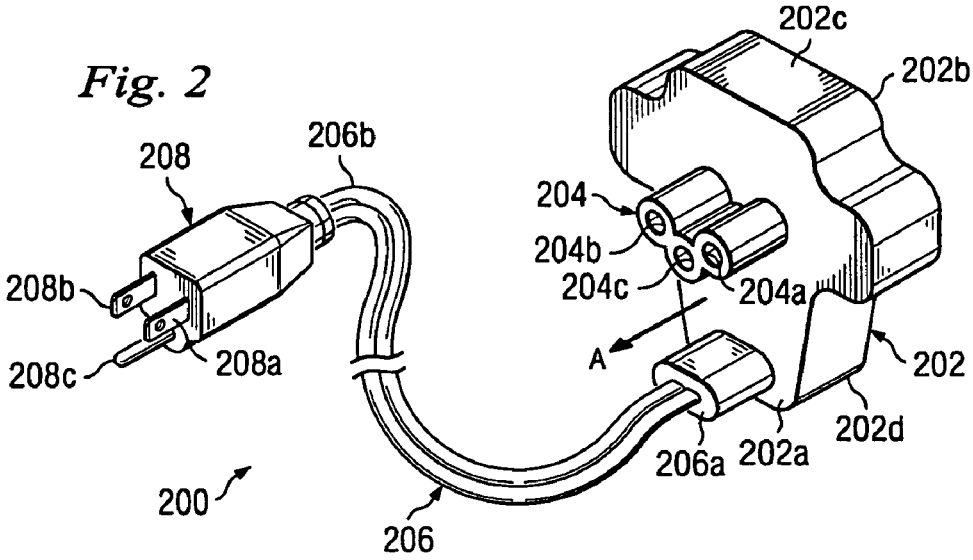
FIG. 2 is a perspective view illustrating an embodiment of a cable connecting apparatus.

Referring now to FIG. 2, a cable connecting apparatus 200 is illustrated. Cable connecting apparatus 200 includes a base 202 having a front surface 202*a*, a rear surface 202*b* located opposite the front surface 202*a*, a top surface 202*c* extending between the front surface 202*a* and the rear surface 202*b*, and a bottom surface 202*d* located opposite the top surface 202*c* and extending between the front surface 202*a* and the rear surface 202*b*. A plug member 204 extends from the front surface 202*a* of the base 202 in a first direction A which, in an embodiment, is substantially perpendicular to the front surface 202*a* of the base 202. In an embodiment, the plug member 204 includes a 3-pin AC connector defining three pin passageways 204*a*, 204*b*, and 204*c*. A cable 206 includes an initial section 206*a* which extends from the front surface 202*a* of the base 202 adjacent the bottom surface 202*d* in the first direction A such that the initial section 206*a* of the cable 206 is in a substantially parallel and spaced apart relationship to the plug member 204. In an embodiment, the initial section 206*a* of the cable 206 is reinforced, as illustrated in FIG. 2. The plug member 204, the base 202, and the initial section 206*a* of the cable 206 each house electrical wiring (not shown) which runs from the passageways 204*a*, 204*b*, and 204*c* in the plug member 204, through the base 202, and to the cable 206 through the initial section 206, providing an electrical coupling with a strain relieved 180 degree bend. The cable 206 includes a distal end 206*b* located opposite the initial section 206*a*. A connector 208 is coupled to the distal end 206*b* of the cable 206 and includes a plurality of electrical coupling pins 208*a*, 208*b*, and 208*c*. In an embodiment, the connector 208 includes a conventional 3-pin AC power connector.

Figure 3:
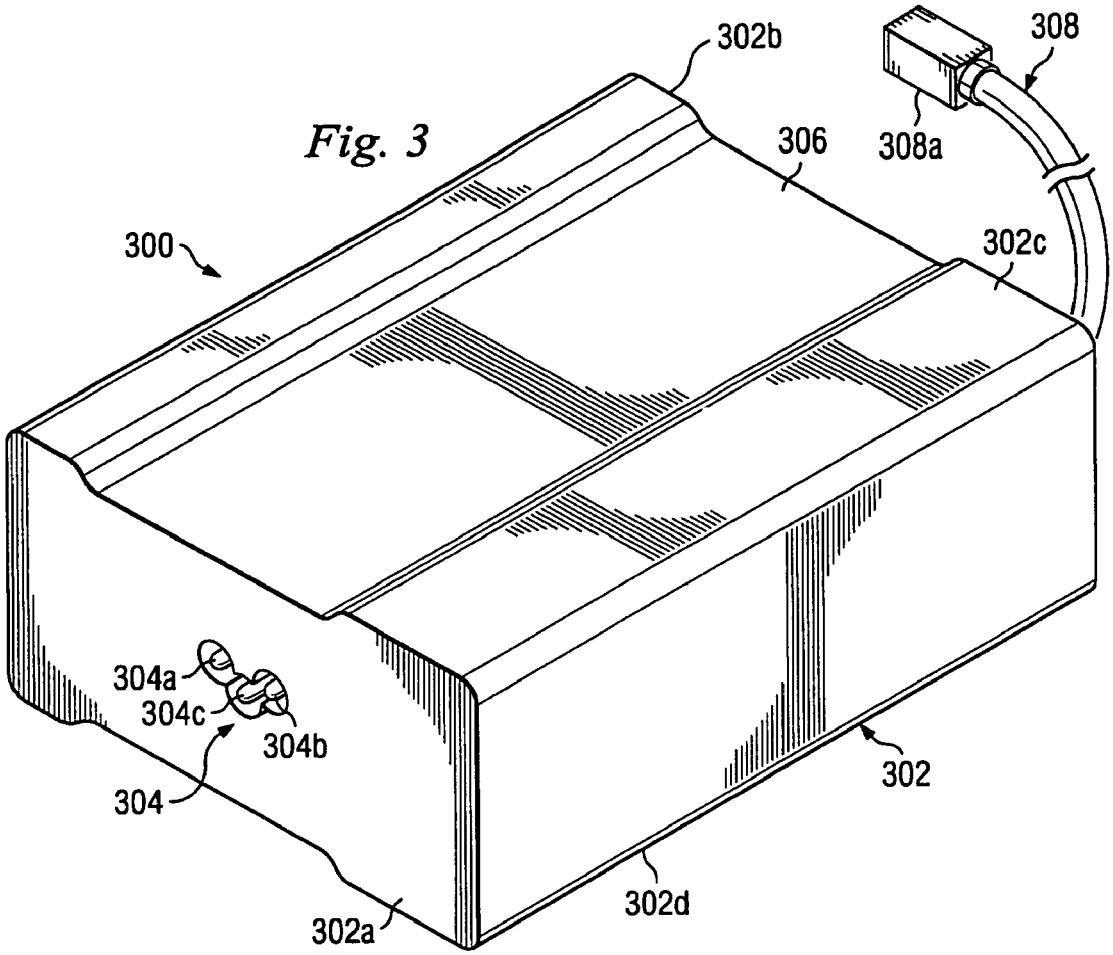
FIG. 3 is a perspective view illustrating an embodiment of a socket member used with the cable connecting apparatus of FIG. 2.

Referring now to FIG. 3, a socket member 300 is illustrated. The socket member 300 includes a base 302 having a front surface 302*a*, a rear surface 302*b* located opposite the front surface 302*a*, a top surface 302*c* extending between the front surface 302*a* and the rear surface 302*b*, and a bottom surface 302*d* located opposite the top surface 302*c* and extending between the front surface 302*a* and the rear surface 302*b*. A plug socket 304 is defined by the base 302 and substantially centrally located on the front surface 302*a* of the base 302. The plug socket 304 includes a plurality of coupling pins 304*a*, 304*b*, and 304*c* located in the plug socket 304 in a spaced apart relationship. In an embodiment, the plug socket 304 is designed to accept a 3-pin AC connector. A cable channel 306 is defined by the base 302 and is located about the base 302 on the front surface 302*a*, the top surface 302*c*, the rear surface 302*b*, and the bottom surface 302*d*. An information handling system cable 308 extends from the rear surface 302*b* of the base 302 and includes an information handling system connector 308*a* on its distal end. In an embodiment, the socket member 300 is an AC power adapter.

Figure 4:
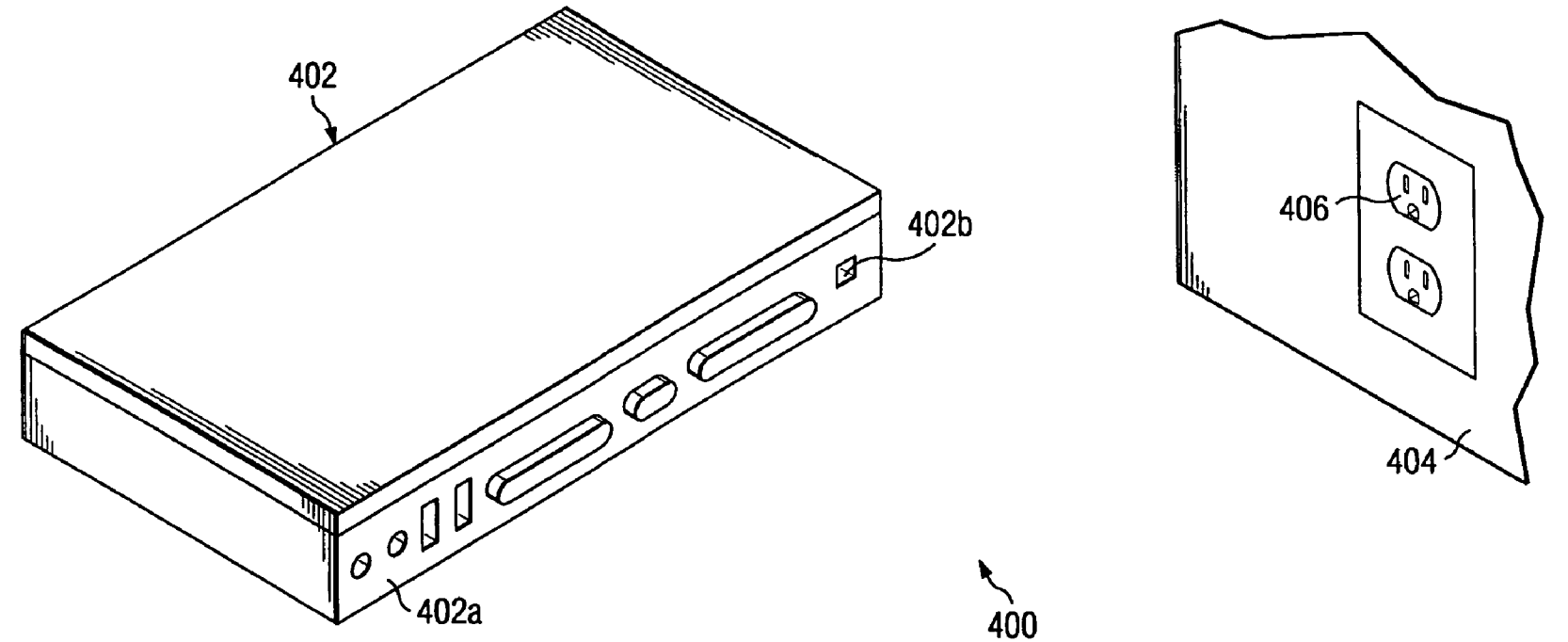
FIG. 4 is a perspective view illustrating an embodiment of an information handling system used with the cable connecting apparatus of FIG. 2 and the socket member of FIG. 3.

Referring now to FIG. 4, an information handling system 400 is illustrated. The information handling system 400 includes a chassis 402 having a rear surface 402*a* including a cable connector 402*b*. In an embodiment, the information handling system 400 may be the information handling system 100, described above with reference to FIG. 1, and the chassis 402 may be the chassis 116, described above with reference to FIG. 1. A wall 404 includes a power outlet 406 which is coupled to a conventional power source (not shown).

Figure 5A:
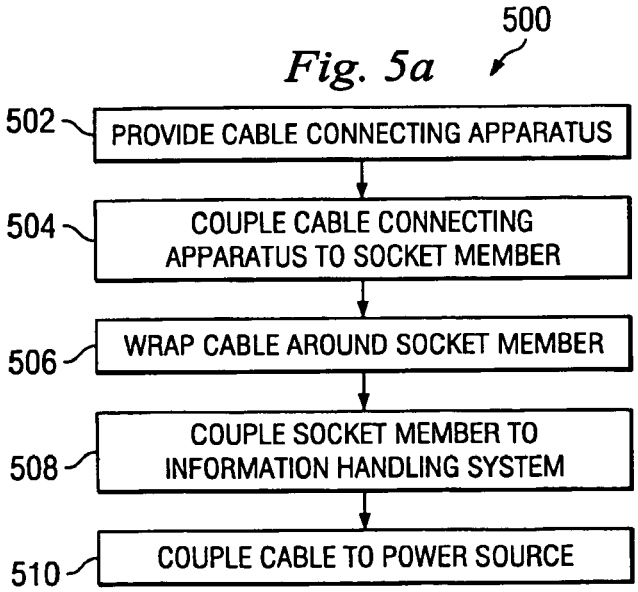
FIG. 5*a* is a flow chart illustrating an embodiment of a method for connecting a cable.
Figure 5B:
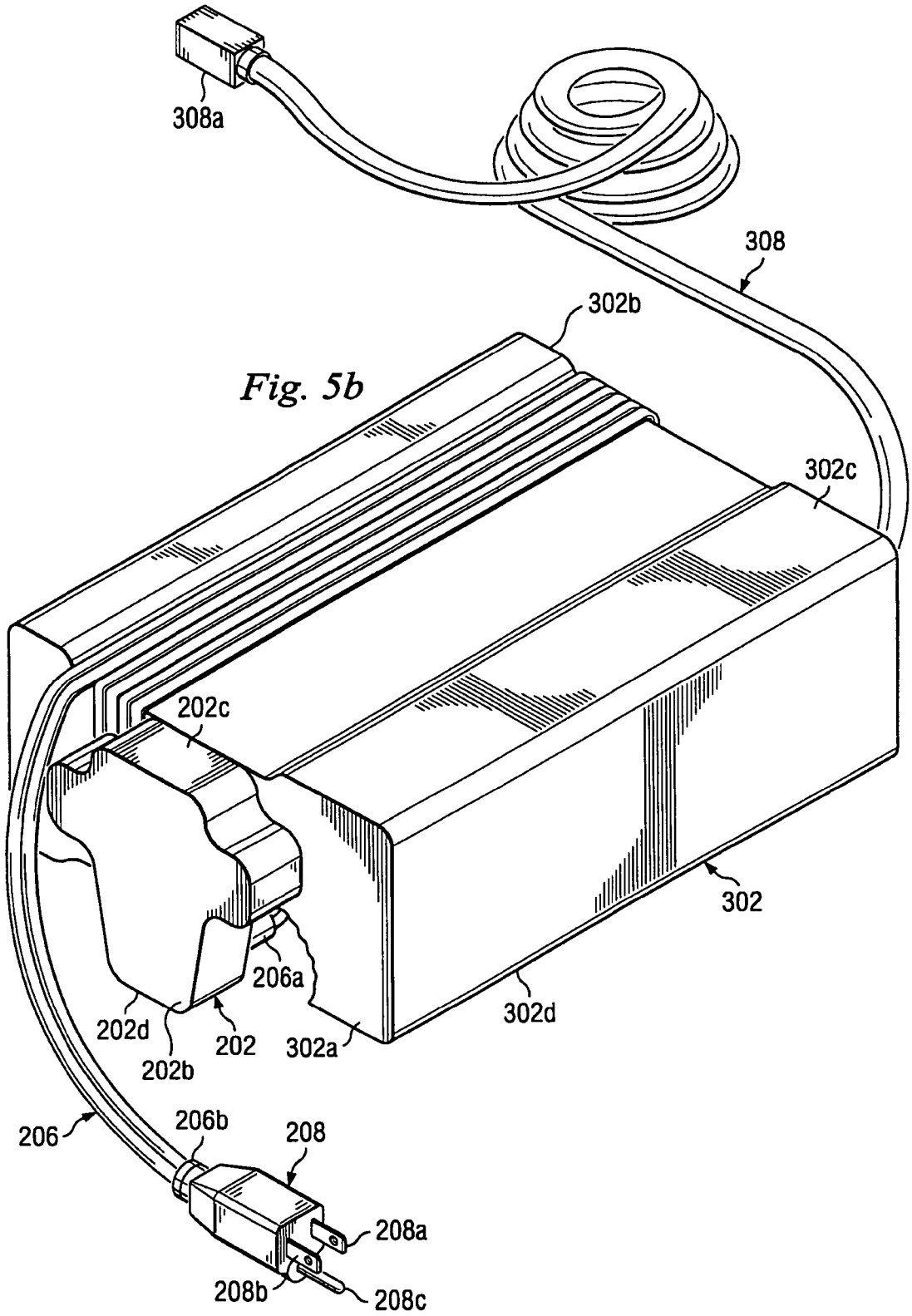
FIG. 5*b* is a perspective view illustrating an embodiment of the cable connecting apparatus of FIG. 2 coupled to the socket member of FIG. 3.
Figure 5C:
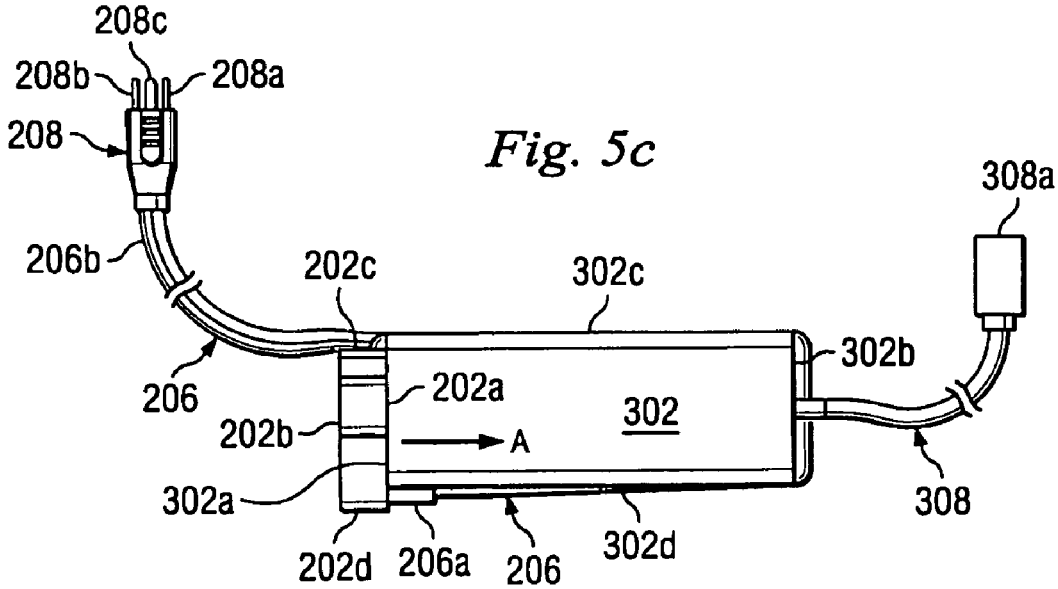
FIG. 5*c* is a side view illustrating an embodiment of the cable connecting apparatus and the socket member of FIG. 5*b*.

Referring now to FIGS. 2, 3, 5*a*, 5*b*, and 5*c*, a method 500 for connecting a cable is illustrated. The method 500 begins at step 502 where the cable connecting apparatus 200, described above with reference to FIG. 2, is provided. The method 500 then proceeds to step 504 where the cable connecting apparatus 200 is coupled to the socket member 300. The base 202 on the cable connecting apparatus 200 is positioned adjacent the socket member 300 such that the front surface 202*a* of the base 202 is adjacent the front surface 302*a* of the base 302 on the socket member 300. The plug member 204 on cable connecting apparatus 200 is aligned with the plug socket 304 and the plug member 204 is then engaged with the plug socket 304 such that the coupling pins 304*a*, 304*b*, and 304*c* enter the pin passageways 204*a*, 204*b*, and 204*c*, respectively. With the plug member 204 engaging the plug socket 304, the initial section 206*a* of the cable 206 extends from the front surface 202*a* of the base 202 in a substantially parallel orientation to the bottom surface 302*d* of the base 302 on socket member 300, as illustrated in FIG. 5*c*.

The method 500 then proceeds to step 506 where the cable 206 is wrapped around the socket member 300. With the initial section 206*a* of the cable 206 extending in a substantially parallel orientation to the bottom surface 302*d* of the base 302 on socket member 300, the cable 206 may be positioned in the cable channel 206 defined by the base 302 of the socket member 300 and wrapped around the socket member 300 as illustrated in FIGS. 5*b* and 5*c*. Due to the cable connecting apparatus providing a strain relieved 180 degree bend, the wrapping of the cable 206 around the socket member 300 puts relatively little stress on the cable 206 as compared to conventional methods. In an embodiment, the cable channel 306 is rounded along the transitions between the front surface 302*a* of the base 302, the top surface 302*c* of the base 302, the rear surface 302*b* of the base 302, and the bottom surface 302*d* of the base, as illustrated in FIG. 3, in order to further reduce stress in the cable 206 due to the wrapping of the cable 206 around the socket member 300. While the cable connecting apparatus 200 has been described connecting the cable 206 to the socket member 300, it should be understood that the cable connecting apparatus 200 may be used with any device that might benefit from a strain relieved 180 degree bend between the plug member 204 and the cable 206.

Figure 5D:
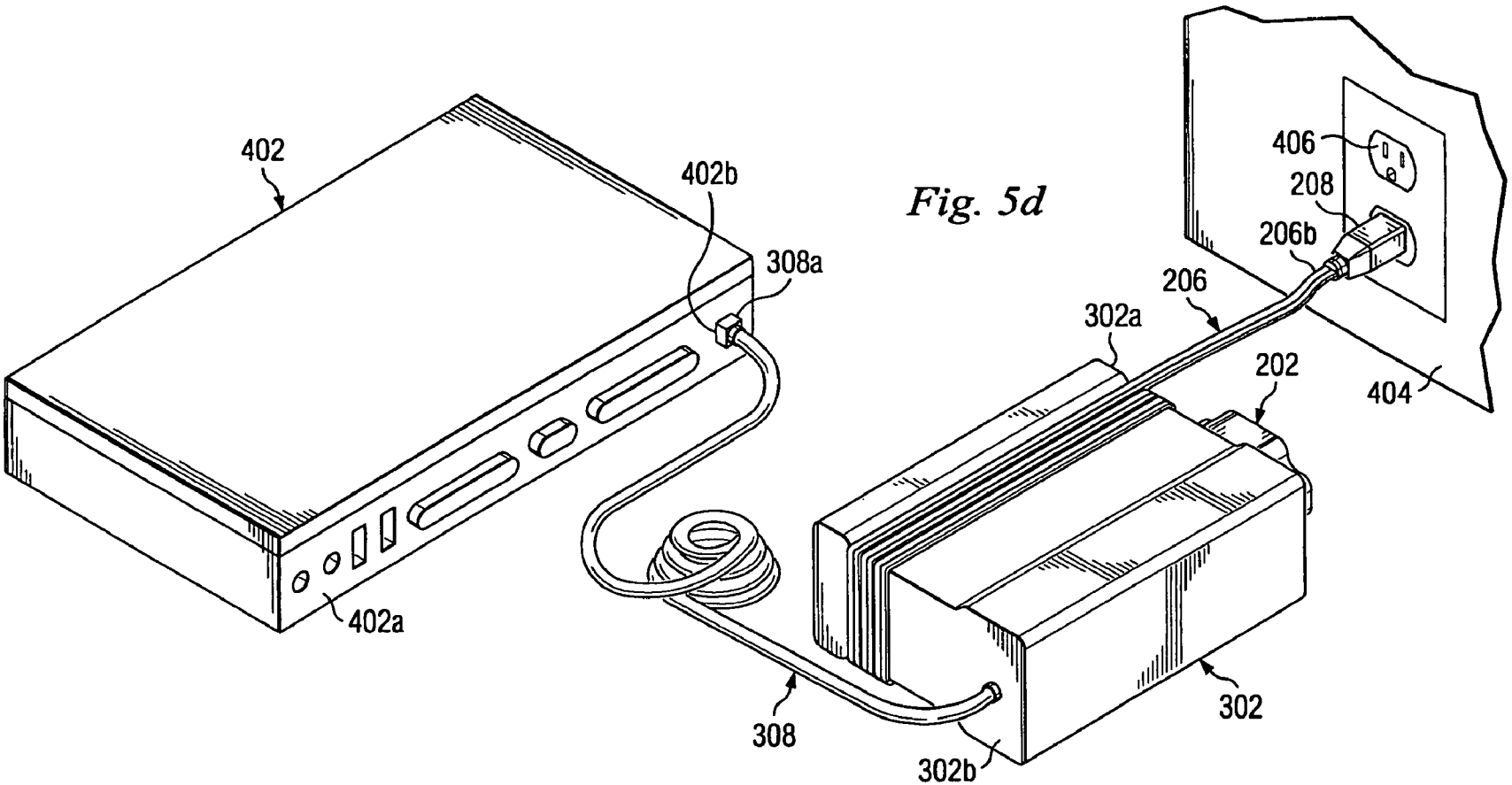
FIG. 5*d* is a perspective view illustrating an embodiment of the cable connecting apparatus and the socket member of FIG. 5*a* coupled to the information handling system of FIG. 4.

Referring now to FIGS. 4, 5*a*, and 5*d*, the method 500 proceeds to step 508 where the socket member 300 is coupled to the information handling system 400. The information handling system connector 308*a* on the distal end of information handling system cable 308 is engaged with cable connector 402*b* on the rear surface 402*a* of information handling system 400, as illustrated in FIG. 5*d*. The method 500 then proceeds to step 510 where the cable 206 is coupled to a power source. The connector 208 on the distal end 206*b* of the cable 206 is coupled to the power outlet 406 on wall 404 by engaging the plurality of electrical coupling pins 208*a*, 208*b*, and 208*c* with the power outlet 406. Thus, a method and apparatus are provided for connecting a cable which reduces the stresses experienced by the cable relative to conventional methods. In an embodiment, the information handling system cable 308 may also include a strain relieved 180 degree bend which allows the information handling system cable 308 to be wrapped around the socket member 300 in the cable channel 306 in a substantially similar manner to the cable 206.

Figure 6:
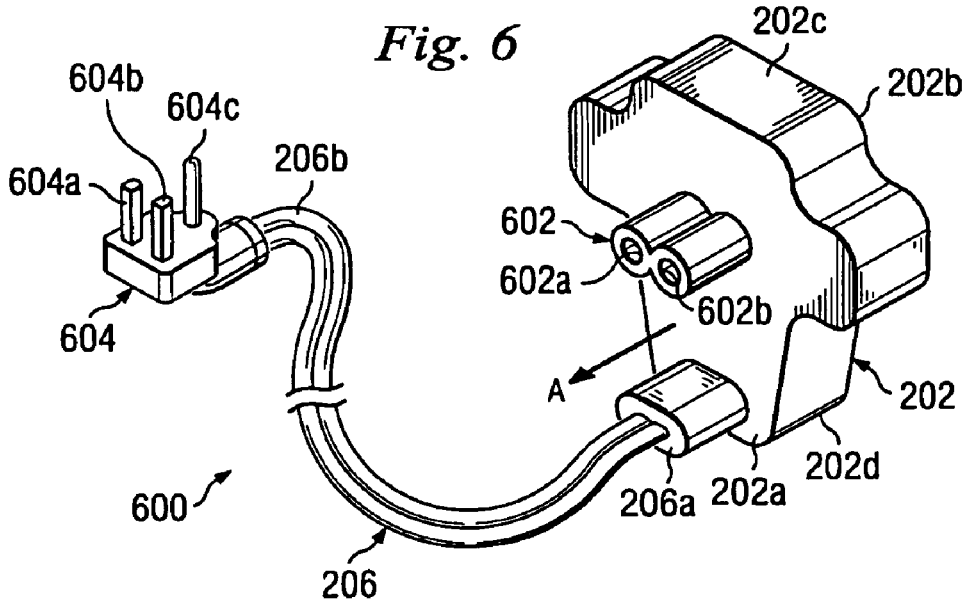
FIG. 6 is a perspective view illustrating an alternative embodiment of a cable connecting apparatus.

Referring now to FIG. 6, in an alternative embodiment, a cable connecting apparatus 600 is substantially similar in design and operation to the cable connecting apparatus 200, described above with reference to FIGS. 2, 3, 5*a*, 5*b*, 5*c*, and 5*d*, with the provision of a modified plug member 602 and a modified connector 604. The plug member 602 extends from the front surface 202*a* of the base 202 in the first direction A which, in an embodiment, is substantially perpendicular to the front surface 202*a* of the base 202. In an embodiment, the plug member 204 includes a 2-pin AC connector defining two pin passageways 602*a* and 602*b*. The connector 604 is coupled to the distal end 206*b* of the cable 206, includes a plurality of electrical coupling pins 604*a*, 604*b*, 604*c*, and provides a strain relieved 90 degree bend between the cable 206 and the electrical coupling pins 604*a*, 604*b*, 604*c*. In an embodiment, the connector 604 includes a conventional 2-pin AC power connector.

Figure 7:
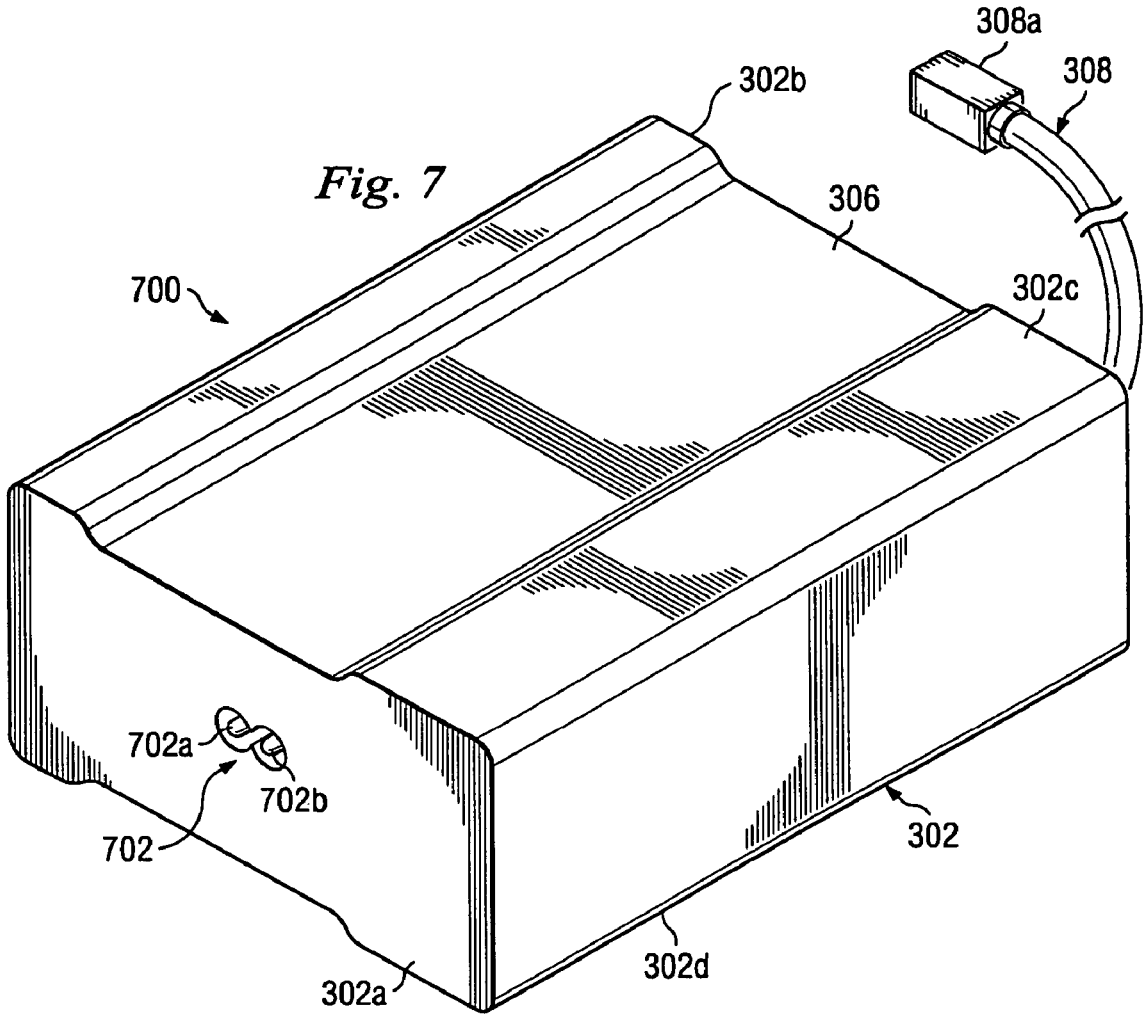
FIG. 7 is a perspective view illustrating an alternative embodiment of a socket member used with the cable connecting apparatus of FIG. 6.

Referring now to FIG. 7, in an alternative embodiment, a socket member 700 is substantially similar in design and operation to the socket member 300, described above with reference to FIGS. 3, 5*a*, 5*b*, 5*c*, and 5*d*, with the provision of a modified plug socket 702. The plug socket 702 is defined by the base 302 and substantially centrally located on the front surface 302*a* of the base 302. The plug socket 702 includes a plurality of coupling pins 702*a* and 702*b* located in the plug socket 702 in a spaced apart relationship. In an embodiment, the plug socket 702 is operable to accept a 2-pin AC connector. In operation, the cable connecting apparatus 600 and the socket member 700 may be used with the information handling system 400 in the method 500 in place of the cable connecting apparatus 200 and the socket member 300.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A cable connecting apparatus, comprising:

a base having a plug member extending from the base in a first direction, wherein the plug member comprises a length such that when the plug member is coupled to a power adapter, a majority of the plug member is housed in a socket defined by the power adapter and the power adapter is located immediately adjacent the base;

a cable extending from the base in the first direction, wherein the cable extends from a location on the base that is spaced apart from the plug member;

a power connector located on a distal end of the cable opposite the base; and an electrical coupling coupled to the power connector, extending through the cable and the base, and coupled to the plug member, wherein the electrical coupling comprises a means for transmitting power from the power connector, through the cable, and to the plug member such that power may be supplied to the power adapter.

2. The apparatus of claim 1, wherein the plug member and the cable extend from a surface of the base, whereby an initial section of the cable is located on the surface spaced apart from and substantially parallel to the plug member.

3. The apparatus of claim 1, wherein the plug member is a 3-pin AC connector.

4. The apparatus of claim 1, wherein the plug member is a 2-pin AC connector.

5. The apparatus of claim 1, wherein an initial section of the cable comprises a reinforced section of cable.

6. The apparatus of claim 1, wherein the power connector on the distal end of the cable comprises a 3-pin AC power connector.

7. The apparatus of claim 1, wherein the base, the plug member, and an initial section of the cable provide the electrical coupling with a strain relieved 180 degree bend.

8. The apparatus of claim 1, further comprising:

a power adapter comprising a socket, whereby with the plug member coupled to the socket, an initial section of the cable extends from the base in a substantially parallel orientation to a surface of the power adapter.

9. The apparatus of claim 8, wherein the power adapter defines a cable channel.

10. An information handling system, comprising:

a chassis comprising a cable connector, a microprocessor mounted to the chassis;

a power adapter including a socket and that is coupled to the cable connector; and a cable connecting apparatus coupled to the power adapter, the cable connecting apparatus comprising:

a base having a plug member located on the base, the plug member extending from a surface of the base and coupled to the socket such that a majority of the plug member is located in the socket and the power adapter is located immediately adjacent the surface of the base;

a cable extending from a location on the base that is spaced apart from the plug member, whereby an initial section of the cable extends from the surface of the base on the same side of the base as the power adapter;

a power connector located on a distal end of the cable opposite the base; and an electrical coupling running through the cable and the base to the plug member, wherein the electrical coupling comprises means for transmitting power from the power connector, through the cable, and to the plug member such that power may be supplied to the power adapter.

11. The system of claim 10, wherein the plug member and the cable extend from a surface of the base, whereby the initial section of the cable is located on the surface spaced apart from and substantially parallel to the plug member.

12. The system of claim 10, wherein the plug member is a 3-pin AC connector.

13. The system of claim 10, wherein the plug member is a 2-pin AC connector.

14. The system of claim 10, wherein the initial section of the cable comprises a reinforced section of cable.

15. The system of claim 10, wherein the power connector on the distal end of the cable comprises a 3-pin AC power connector.

16. The system of claim 10, wherein the base, the plug member, and the initial section of the cable provide the electrical coupling with a strain relieved 180 degree bend.

17. The system of claim 10, wherein the initial section of the cable extends from the base in a substantially parallel orientation to and immediately adjacent a surface of the power adapter.

18. The system of claim 17, wherein the power adapter defines a cable channel.

19. A method for connecting a cable, comprising:

providing a cable connecting apparatus comprising a base having a plug member located on the base and extending from the base in a first direction, an initial section of the cable extending from the base in the first direction at a location on the base that is spaced apart from the plug member, a power connector located on a distal end of the cable opposite the base, and an electrical coupling coupled to the power connector, extending through the cable and the base, and coupled to the plug member;

coupling the plug member to a power adapter by locating a majority of the plug member in a socket defined by the power adapter such that the power adapter is located immediately adjacent the base, whereby with the plug member coupled to the power adapter, the initial section of the cable extends from the base in a substantially parallel orientation to and immediately adjacent a surface of the power adapter;

transmitting power from the power connector, through the cable, and to the plug member using the electrical coupling; and supplying power to the power adapter through the plug member.

20. The method of claim 19, further comprising:

wrapping the cable around the power adapter, whereby the base, the plug member, and the initial section of the cable provide a strain relieved 180 degree bend for the electrical coupling.

21. The method of claim 19, further comprising:

coupling the power adapter to an information handling system; and coupling the power connector to a power source.

22. A cable coupling apparatus, comprising:

a power adapter comprising a power adapter base that defines a socket; and a power cable operable to couple to the power adapter, the power cable comprising:

a power cable base having a plug member that is operable to engage the socket to couple the power cable to the power adapter such that a majority of the plug member is located in the socket and the power adapter base extends from a side of the power cable base;

an initial section of the power cable extending from the power cable base from a location on the power cable base that is spaced apart from the plug member, whereby with the power cable coupled to the power adapter, the initial section of the power cable extends from the power cable base on the same side of the power cable base as the power adapter base;

a power connector located on a distal end of the power cable opposite the power cable base; and an electrical coupling coupled to the power connector, extending through the power cable and the power cable base, and coupled to the plug member such that power may be supplied through the electrical coupling to the power adapter.

* * * * *